US009799281B2

(12) United States Patent
Lien et al.

(10) Patent No.: US 9,799,281 B2
(45) Date of Patent: Oct. 24, 2017

(54) LIQUID CRYSTAL PANEL AND DRIVING METHOD FOR THE SAME

(71) Applicant: Shenzhen China Star Optoelectronics Technology Co., Ltd., Shenzhen, Guangdong (CN)

(72) Inventors: Shui-chih Lien, Guangdong (CN); Yu-yeh Chen, Guangdong (CN); Jiang Zhu, Guangdong (CN); Lei Sun, Guangdong (CN); Dongsheng Guo, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 230 days.

(21) Appl. No.: 14/653,848

(22) PCT Filed: May 18, 2015

(86) PCT No.: PCT/CN2015/079174
§ 371 (c)(1),
(2) Date: Jun. 18, 2015

(87) PCT Pub. No.: WO2016/173006
PCT Pub. Date: Nov. 3, 2016

(65) Prior Publication Data

US 2017/0140715 A1 May 18, 2017

(30) Foreign Application Priority Data

Apr. 29, 2015 (CN) ..... 2015 1 0210268

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/3648* (2013.01);
(Continued)

(58) Field of Classification Search
CPC .. G09G 3/3607; G09G 3/2003; G09G 3/3648; G09G 2320/028; G09G 2300/0452
See application file for complete search history.

(56) References Cited

U.S. PATENT DOCUMENTS

2006/0103615 A1* 5/2006 Shih ..... G09G 3/3607 345/88
2006/0152443 A1 7/2006 Song et al.
(Continued)

FOREIGN PATENT DOCUMENTS

CN 101226289 A 7/2008

*Primary Examiner* — Premal Patel
(74) *Attorney, Agent, or Firm* — Andrew C. Cheng

(57) ABSTRACT

A liquid crystal panel and a driving method are disclosed. The method includes the following steps: receiving a picture information; analyzing and obtaining an original grayscale of each color of multiple pixel units; generating a first display grayscale and a second display grayscale according to the original grayscale of each color, wherein, a display brightness corresponding to the first display grayscale is greater than a display brightness corresponding to the second display grayscale; and using the first display grayscale and the second display grayscale of each color of the multiple pixel units to drive sub-pixel units which is corresponding to the each color in two adjacent pixel units corresponding to each pixel unit to respectively perform a dark display and a bright display. Through above way, the present invention can increase the transmittance of the liquid crystal panel.

9 Claims, 6 Drawing Sheets

(52) U.S. Cl.
CPC ..... *G09G 2300/0452* (2013.01); *G09G 2320/028* (2013.01)

(56) References Cited

U.S. PATENT DOCUMENTS

2009/0129698 A1* 5/2009 Wang ..... G09G 3/20 382/274
2009/0256865 A1* 10/2009 Jun ..... G09G 3/3688 345/690
2012/0086743 A1* 4/2012 Shiomi ..... G02F 1/136213 345/694
2012/0262503 A1* 10/2012 Lin ..... G09G 5/10 345/690
2012/0268357 A1* 10/2012 Shih ..... G09G 3/3607 345/88
2013/0194170 A1* 8/2013 Saitoh ..... G09G 3/20 345/103
2013/0321483 A1* 12/2013 You ..... G09G 5/10 345/690
2015/0325165 A1* 11/2015 Mori ..... G09G 3/2025 345/698
2016/0232859 A1* 8/2016 Oh ..... G09G 3/3611

* cited by examiner

LIQUID CRYSTAL PANEL AND DRIVING METHOD FOR THE SAME

BACKGROUND OF THE INVENTION

1. Field of the Invention

The present invention relates to a display technology, and more particular to a liquid crystal panel and a driving method for the same.

2. Description of Related Art

Because a liquid crystal panel has a small size, a light weight, low power consumption and an excellent display quality, the liquid crystal panel has rapidly developed. With the improvement of the life quality, people have stronger demand for a large size and high-resolution liquid crystal panel.

Because liquid crystal molecules have optical anisotropy, a liquid crystal panel has a color shift problem at a large viewing angle. In order to solve the color shift problem, in the conventional art, a multi-domain structure of the liquid crystal panel is provided. As shown in FIG. 1, each sub-pixel unit 100 of a pixel unit 10 is further divided into smaller display units such as a first display unit 101 used for a main pixel and a second display unit 102 used for an auxiliary pixel. A driving voltage of the main pixel and a driving voltage of auxiliary pixel have a certain proportion such that the liquid crystal molecules of the display units are tilted at different angles in order to obtain a better viewing effect at different angles.

However, for the conventional multi-domain structure of the liquid crystal panel, the first display unit 101 used for the main pixel and the second display unit 102 used for the auxiliary pixel are separated such that a gap is existed. Therefore, the conventional liquid crystal panel has a drawback of a low transmittance.

SUMMARY OF THE INVENTION

The main technology problem solved by the present invention is to provide a liquid crystal panel and a driving for the same, which can increase the transmittance of the liquid crystal panel.

In order to solve the above technology problems, a technology solution adopted by the present invention is: a driving method for a liquid crystal panel, wherein, the liquid crystal panel includes multiple pixel units arranged as a matrix, each pixel unit includes multiple sub-pixel units arranged sequentially and corresponding to different colors, the driving method comprising following steps: receiving a picture information; analyzing and obtaining an original grayscale of each color of the multiple pixel units; generating a first display grayscale and a second display grayscale according to the original grayscale of the each color, wherein, a display brightness corresponding to the first display grayscale is greater than a display brightness corresponding to the second display grayscale, and a display brightness corresponding to the original grayscale is a half of a sum of the display brightness corresponding to the first display grayscale and the display brightness corresponding to the second display grayscale; and using the first display grayscale and the second display grayscale of the each color of the multiple pixel units to drive sub-pixel unit which is corresponding to the each color in two adjacent pixel units corresponding to each pixel unit to respectively perform a dark display and a bright display; wherein, the sub-pixel units includes a R, a G, a B and a W sub-pixel units, and the R, G, B and W sub-pixel units respectively display a red color, a green color, a blue color and a white color.

Wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes: using one sub-pixel unit as one unit to drive sub-pixel units to alternately perform a dark display and a bright display, wherein, when one of the sub-pixel units is driven by the first display grayscale, adjacent and peripheral sub-pixel units are driven by the second display grayscale, and when one of the sub-pixel units is driven by the second display grayscale, adjacent and peripheral sub-pixel units are driven by the first display grayscale.

Wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes: using a combination of the sub-pixel units as one unit to drive the sub-pixel units to alternately perform a dark display and a bright display, wherein, each combination of the sub-pixel units includes at least two adjacent sub-pixel units, when a combination of the sub-pixel units is driven by a first display grayscale, adjacent and peripheral combinations of the sub-pixel units are driven by a second display grayscale, and when a combination of the sub-pixel units is driven by a second display grayscale, adjacent and peripheral combinations of the sub-pixel units are driven by a first display grayscale.

Wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes: using one row or one column as one unit to drive the sub-pixel units of one row or one column to alternately perform a dark display and a bright display, wherein, when sub-pixel units of one row or one column are driven by a first display grayscale, adjacent and peripheral sub-pixel units of one row or one column are driven by a second display grayscale, and when sub-pixel units of one row or one column are driven by a second display grayscale, adjacent and peripheral sub-pixel units of one row or column are driven by a first display grayscale.

In order to solve the above technology problems, another technology solution adopted by the present invention is: a driving method for a liquid crystal panel, wherein, the liquid crystal panel includes multiple pixel units arranged as a matrix, each pixel unit includes multiple sub-pixel units arranged sequentially and corresponding to different colors, the driving method comprising following steps: receiving a picture information; analyzing and obtaining an original grayscale of each color of the multiple pixel units; generating a first display grayscale and a second display grayscale according to the original grayscale of the each color, wherein, a display brightness corresponding to the first display grayscale is greater than a display brightness corresponding to the second display grayscale; and using the first display grayscale and the second display grayscale of the each color of the multiple pixel units to drive sub-pixel units which is corresponding to the each color in two adjacent pixel units corresponding to each pixel unit to respectively perform a dark display and a bright display.

In order to solve the above technology problems, another technology solution adopted by the present invention is: a liquid crystal panel, comprising: multiple pixel units arranged as a matrix, each pixel unit includes multiple sub-pixel units arranged sequentially and corresponding to different colors; and a driving circuit including: a receiving module used for receiving a picture information; a resolution module used for analyzing and obtaining an original grayscale of each color of the multiple pixel units in the picture information; a grayscale generation module used for generating a first display grayscale and a second display grayscale according to the original grayscale of the each color, wherein, a display brightness corresponding to the first display grayscale is greater than a display brightness corresponding to the second display grayscale; and a display driving module used for utilizing the first display grayscale and the second display grayscale of the each color of the multiple pixel units to drive sub-pixel unit which is corresponding to the each color in two adjacent pixel units corresponding to each pixel unit to respectively perform a dark display and a bright display.

Wherein, the display driving module further uses one sub-pixel unit as one unit to drive sub-pixel units to alternately perform a dark display and a bright display, wherein, when one of the sub-pixel units is driven by the first display grayscale, adjacent and peripheral sub-pixel units are driven by the second display grayscale, and when one of the sub-pixel units is driven by the second display grayscale, adjacent and peripheral sub-pixel units are driven by the first display grayscale.

Wherein, the display driving module further uses a combination of the sub-pixel units as one unit to drive the sub-pixel units to alternately perform a dark display and a bright display, wherein, each combination of the sub-pixel units includes at least two adjacent sub-pixel units, when a combination of the sub-pixel units is driven by a first display grayscale, adjacent and peripheral combinations of the sub-pixel units are driven by a second display grayscale, and when a combination of the sub-pixel units is driven by a second display grayscale, adjacent and peripheral combinations of the sub-pixel units are driven by a first display grayscale.

Wherein, the display driving module further uses one row or one column as one unit to drive the sub-pixel units of one row or one column to alternately perform a dark display and a bright display, wherein, when sub-pixel units of one row or one column are driven by a first display grayscale, adjacent and peripheral sub-pixel units of one row or one column are driven by a second display grayscale, and when sub-pixel units of one row or one column are driven by a second display grayscale, adjacent and peripheral sub-pixel units of one row or column are driven by a first display grayscale.

Wherein, the sub-pixel units includes a red (R), a green (G), a blue (B) and a white (W) sub-pixel units, and the red (R), the green (G), the blue (B) and the white (W) sub-pixel units respectively display a red color, a green color, a blue color and a white color.

The beneficial effect of the present invention is: comparing to the conventional art, firstly, the present invention analyzes and obtains an original grayscale of each color of the multiple pixel units. Then, the present invention generates a first display grayscale and a second display grayscale according to the original grayscale of the each color, wherein, a display brightness corresponding to the first display grayscale is greater than a display brightness corresponding to the second display grayscale. Finally, the present invention uses the first display grayscale and the second display grayscale of the each color of the multiple pixel units to drive sub-pixel units which is corresponding to the each color in two adjacent pixel units corresponding to each pixel unit to respectively perform a dark display and a bright display. Through the above way, the sub-pixel unit of the embodiment of the present invention does not require to be divided into smaller display unit. Under a situation of an entire sub-pixel unit, through alternate dark and bright display method to achieve a large viewing angle characteristic, the transmittance of the liquid crystal panel is increased.

DETAILED DESCRIPTION OF THE PREFERRED EMBODIMENT

Figure 1:
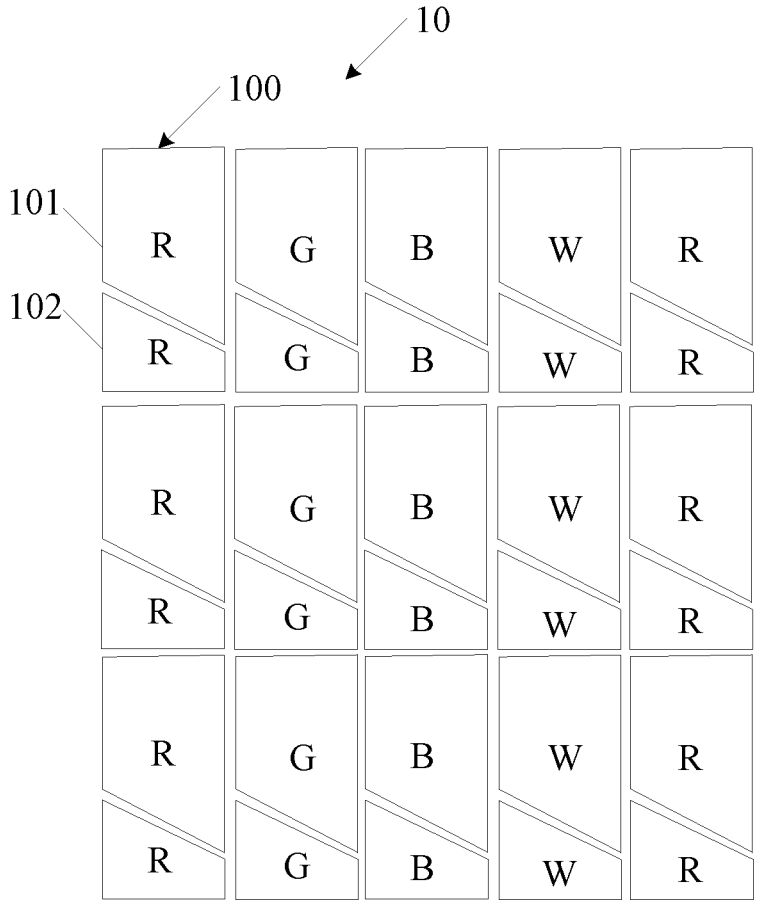
FIG. 1 (Prior Art)
FIG. 1 is a schematic diagram of a pixel unit in the conventional art.
Figure 2:
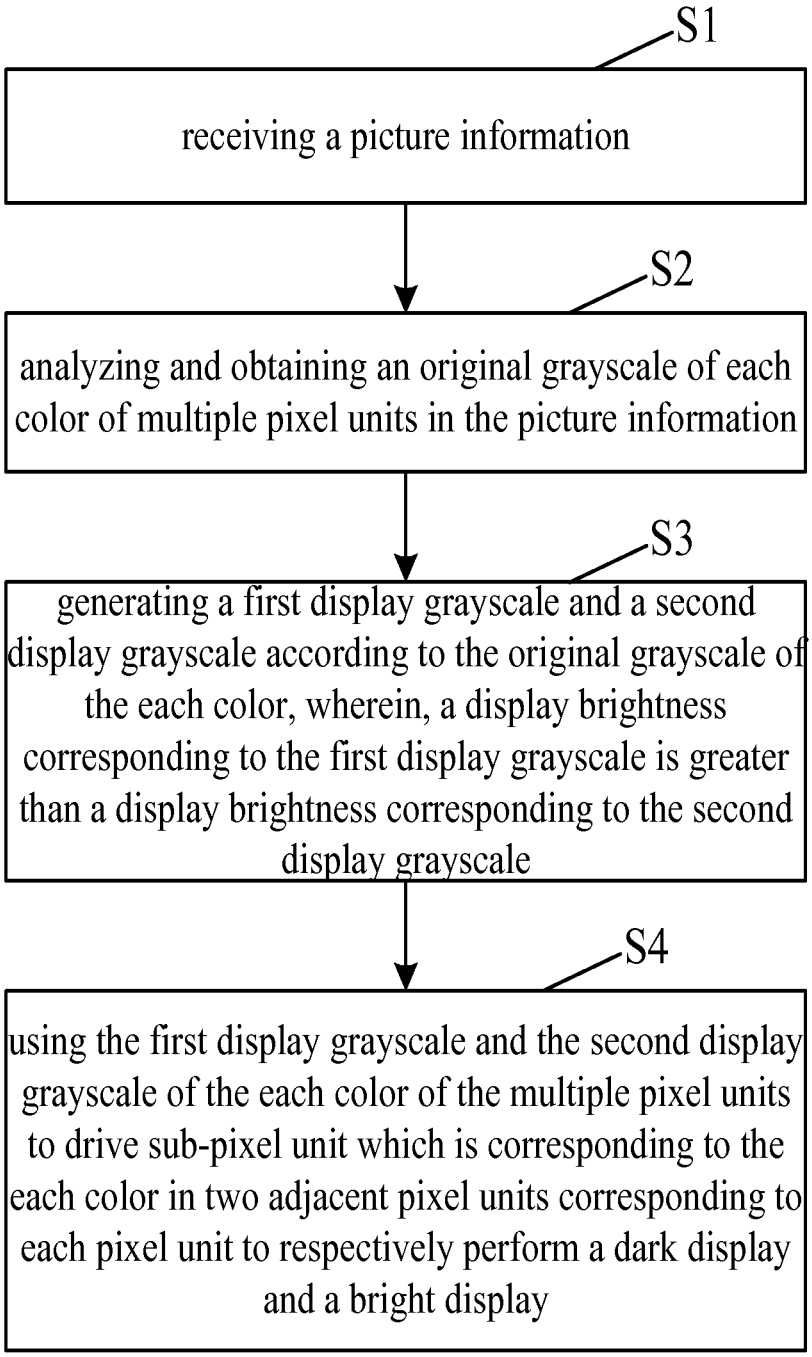
FIG. 2 is a flowchart of a driving method for a liquid crystal panel according to an embodiment of the present invention.

With reference to FIG. 2, FIG. 2 is a flowchart of a driving method for a liquid crystal panel according to an embodiment of the present invention. The driving method of the liquid crystal panel of the present invention includes following steps:

Step S1: receiving a picture information.

Each picture includes following information: each picture is formed by multiple pixels, and each pixel is formed by multiple colors displayed by different grayscales. In the present embodiment, each pixel is formed by four colors of a R (red), G (green), B (blue) and W (white) displayed by different grayscales.

In another embodiment, each pixel could only be formed by three colors of a R (red), a G (green) and a B (blue) displayed by different grayscales.

Step S2: analyzing and obtaining an original grayscale of each color of multiple pixel units in the picture information.

Grayscales can represent different brightness levels of a color from the darkest to the brightest. If the brightness levels are more, a picture effect is finer. Using 8 bit panel as an example, the panel can show the 8th power of 2, which equals to 256 brightness levels. When a color is darker, a corresponding grayscale value is smaller, and vice versa.

Specifically, the present step analyzes a corresponding grayscale according to a brightness of each color in order to obtain an original grayscale.

Step S3: generating a first display grayscale and a second display grayscale according to the original grayscale of the each color. Wherein, a display brightness corresponding to the first display grayscale is greater than a display brightness corresponding to the second display grayscale.

Figure 3:
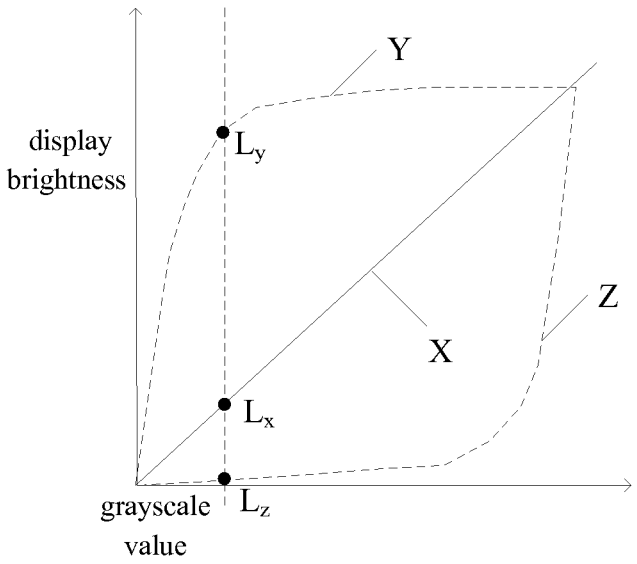
FIG. 3 is a relationship diagram of grayscale value and display brightness according to an embodiment of the present invention.

Specifically, with reference to FIG. 3, FIG. 3 is a relationship diagram of grayscale value and display brightness according to an embodiment of the present invention. As shown in FIG. 3, the horizontal axis represents grayscale value, and the vertical axis represents display brightness. In the present embodiment, the straight line X represents the original grayscale. The curve Y represents the first display grayscale. The curve Z represents the second display grayscale. A relationship among a display brightness Lx corresponding to the original grayscale X, a display brightness Ly corresponding to the first display grayscale Y and a display brightness Lz corresponding to the second display grayscale Z is:

$$Lx=(Ly+Lz)/2$$

That is, the display brightness Lx corresponding to the original grayscale X is a half of a sum of the display brightness Ly corresponding to the first display grayscale Y and the display brightness Lz corresponding to the second display grayscale Z.

It can be understood that the relationship of the grayscale and the display brightness shown in FIG. 3 is suitable for every color (R, G, B and W).

Specifically, the present step generates the first display grayscale and the second display grayscale corresponding to the original grayscale of each color according to the relationship shown in FIG. 3.

Step S4: using the first display grayscale and the second display grayscale of the each color of the multiple pixel units to drive a sub-pixel unit which is corresponding to the each color in two adjacent pixel units corresponding to each pixel unit to respectively perform a dark display and a bright display.

Figure 4:
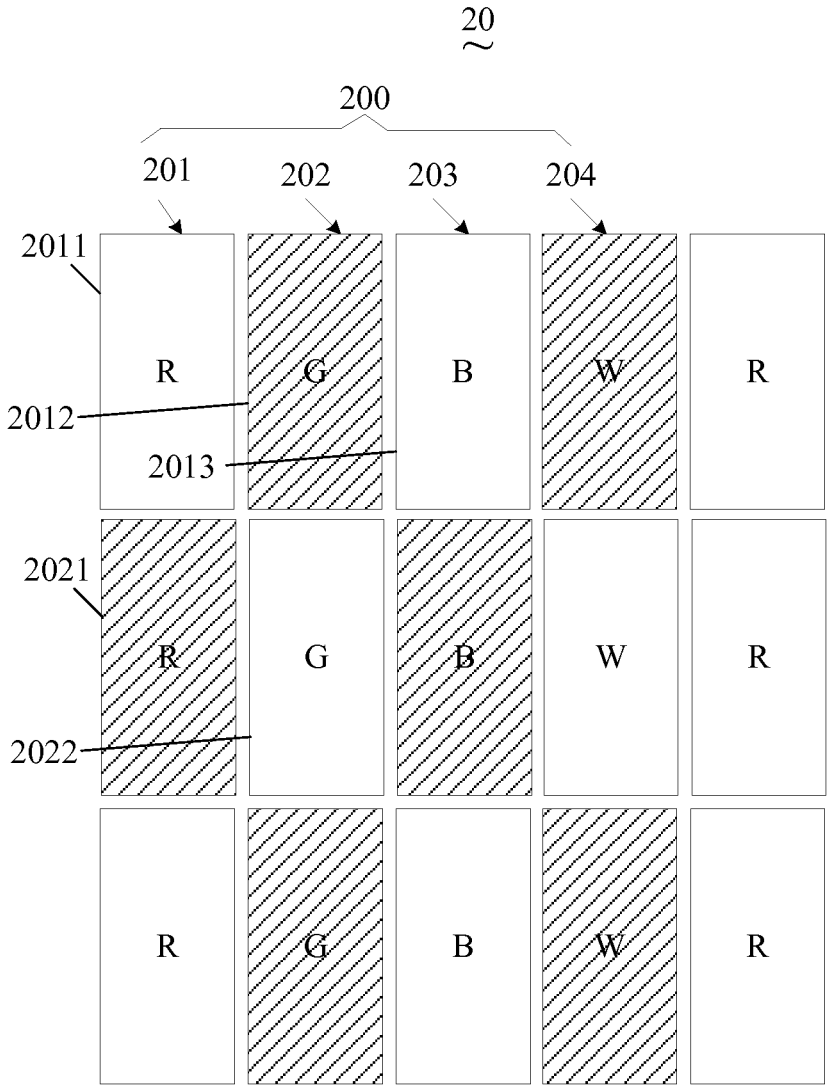
FIG. 4 is a schematic diagram of a pixel unit corresponding to the method shown in FIG. 2.

Specifically, as shown in FIG. 4, the liquid crystal panel 20 of the embodiment of the present invention includes multiple pixel units 200 arranged as a matrix. Each pixel unit 200 includes four sub-pixel units 201-204 arranged sequentially and corresponding to different colors. Specifically, the sub-pixel units include four sub-pixel units of R, G, B and W. The R, G, B and W sub-pixel units respectively display four colors of a red color, a green color, a blue color and a white color.

In another embodiment, the pixel unit 200 may also include three sub-pixel units which only display three colors of a red color, a green color and a blue color.

The step S4 of the embodiment of the present invention specifically includes following three driving methods:

First driving method: as shown in FIG. 4 and using one sub-pixel unit as one unit to drive sub-pixel units to alternately perform a dark display and a bright display. Wherein, when one of the sub-pixel units is driven by the first display grayscale, adjacent and peripheral sub-pixel units are driven by the second display grayscale. When one of sub-pixel units is driven by the second display grayscale, adjacent and peripheral sub-pixel units are driven by the first display grayscale.

For example, as shown in FIG. 4, when a sub-pixel unit 2011 which displays a red color (R) and located at a first row is driven by a first display grayscale, adjacent and peripheral sub-pixel units are respectively a sub-pixel unit 2012 which displays a green color (G) and located at the same first row and a sub-pixel unit 2021 which displays a red color (R) and located at an adjacent next row. Accordingly, the sub-pixel units 2012 and 2021 are both driven by a second display grayscale. When the sub-pixel unit 2012 at the first row is driven by a second display grayscale, adjacent and peripheral sub-pixel units are respectively a sub-pixel unit 2012 which displays a red color (R) and locates at the same first row, a sub-pixel unit 2013 which displays a blue color (B) and locates at the same first row and a sub-pixel unit 2022 which displays a green color (G) and located at an adjacent next row. Accordingly, the sub-pixel units 2011, 2013 and 2022 are driven by the first display grayscale.

Figure 5:
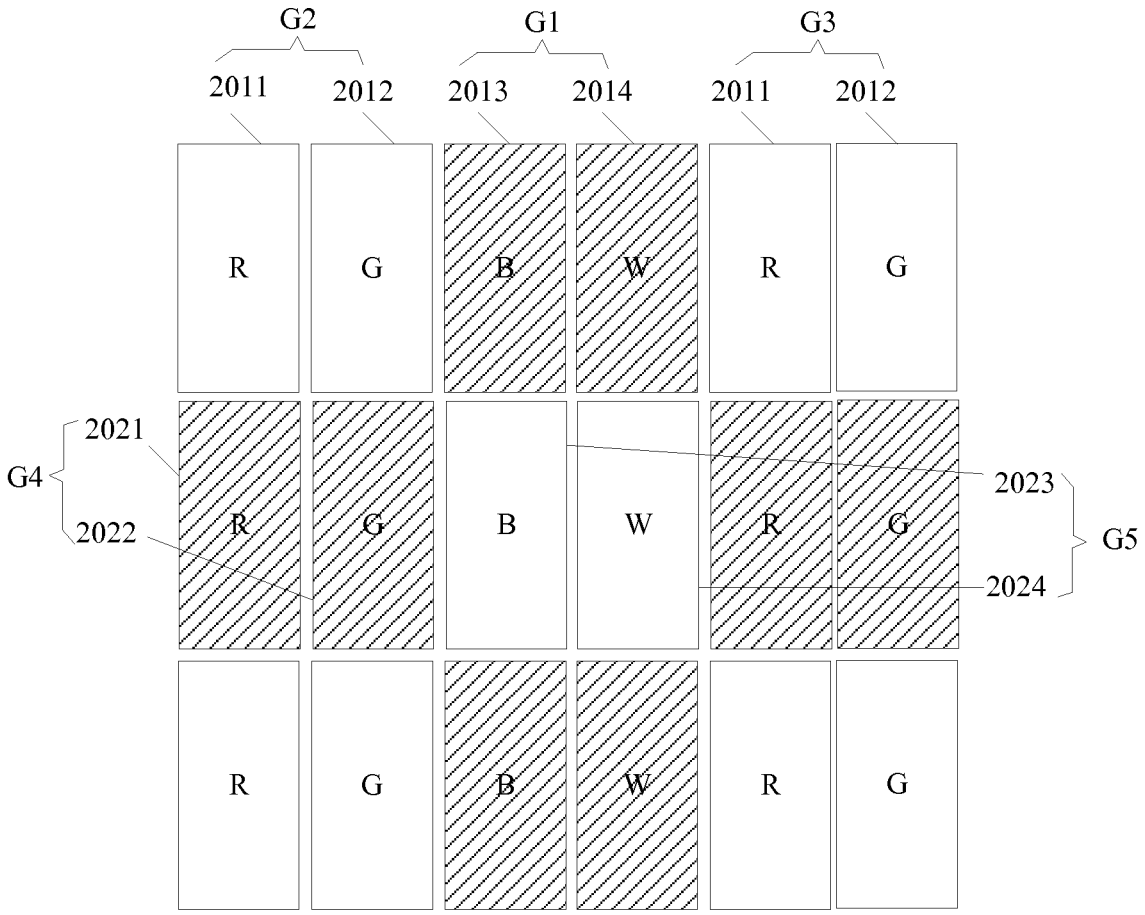
FIG. 5 is a schematic diagram of another pixel unit corresponding to the method shown in FIG. 2.

The second driving method: as shown in FIG. 5, using a combination of the sub-pixel units as one unit to drive sub-pixel units to alternately perform a dark display and a bright display. Wherein, each combination of the sub-pixel units includes at least two adjacent sub-pixel units. When a combination of the sub-pixel units is driven by a first display grayscale, adjacent and peripheral combinations of the sub-pixel units are driven by a second display grayscale. When a combination of the sub-pixel units is driven by a second display grayscale, adjacent and peripheral combinations of the sub-pixel units are driven by a first display grayscale.

For example, as shown in FIG. 5, the combination of the sub-pixel units of the embodiment of the present invention is two adjacent sub-pixel units. Sub-pixel units 2013 and 2014 at a first row are a combination G1. Sub-pixel units adjacent to the combination G1 is combinations G2 and G3. Sub-pixel units 2021 and 2022 which are adjacent to the combination G2 and located at a second row form a combination G4. Sub-pixel units 2023 and 2024 which are adjacent to the combination G1 and located at the second row form a combination G5.

It can be understood that a combination of sub-pixel units of the embodiment of the present invention can also include three or above sub-pixel units.

Besides, FIG. 5 only shows that a combination is formed by sub-pixels located at the same row. In another embodiment, a combination could also be formed by sub-pixels located at the same column. For example, the sub-pixels 2011 and 2021 shown in FIG. 5 can form a combination.

Specifically, the present step is: when the combination G2 is driven by the first grayscale, adjacent and peripheral sub-pixel combinations G1 and G4 are driven by a second display grayscale. When the sub-pixel combination G1 is driven by a second grayscale, adjacent and peripheral sub-pixel combinations G2, G3 and G5 are driven by a first display grayscale.

Figure 6:
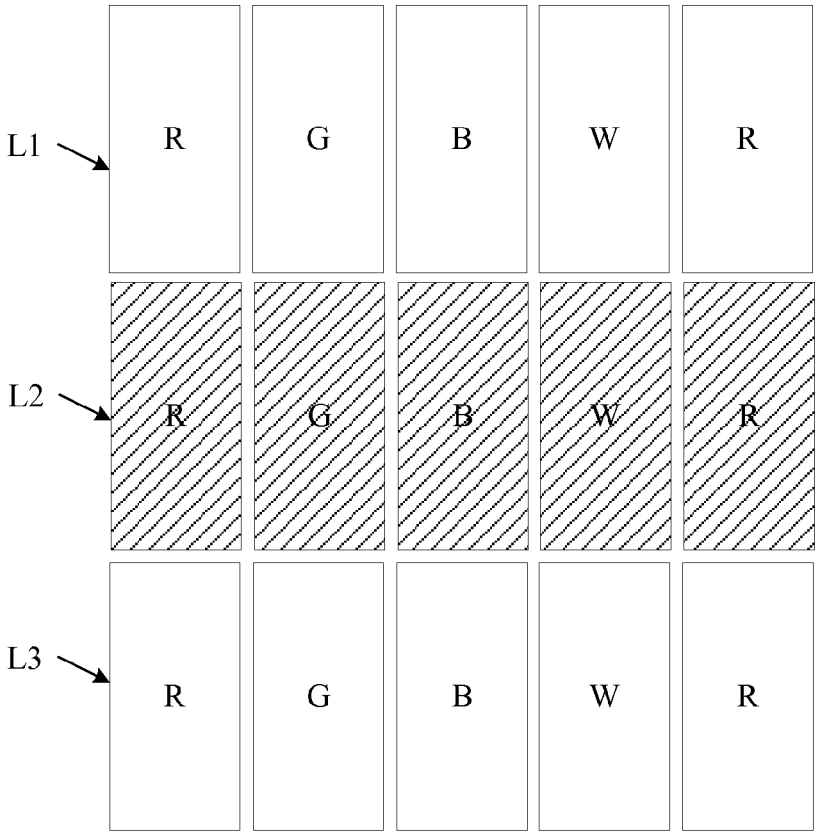
FIG. 6 is a schematic diagram of another pixel unit corresponding to the method shown in FIG. 2.

A third driving method is: as shown in FIG. 6 and using one row or one column as one unit to drive sub-pixel units to alternately perform a dark display and a bright display. Wherein, when sub-pixel units of one row or one column are driven by a first display grayscale, adjacent and peripheral sub-pixel units of one row or one column are driven by a second display grayscale. When sub-pixel units of one row or one column are driven by a second display grayscale, adjacent and peripheral sub-pixel units of one row or column are driven by a first display grayscale.

For example, as shown in FIG. 6, using one row as one unit to perform a dark display and a bright display: when sub-pixel units of a first row L1 are driven by a first display grayscale, adjacent and peripheral sub-pixel units of a second row L2 are driven by a second display grayscale. When sub-pixel units of a second row L2 are driven by a second display grayscale, adjacent and peripheral sub-pixels of first and third rows L1, L3 are driven by a first display grayscale.

Wherein, the operation principle of using one column as one unit to perform a dark display and a bright display is the same as above which using one row as one unit to alternately perform a dark display and a bright display.

In another embodiment of the present invention, the third driving method can be replaced as: driving a combination of sub-pixel units to alternately perform a dark and bright display. Wherein, each combination of sub-pixel units includes sub-pixel units of at least two adjacent rows or sub-pixel units of at least two adjacent columns. When a combination of sub-pixel units is driven by a first display grayscale, adjacent and peripheral combinations of sub-pixel unit are driven by a second display grayscale. When a combination of sub-pixel units is driven by a second display grayscale, adjacent and peripheral combinations of sub-pixel unit are driven by a first display grayscale.

As described above, the sub-pixel unit of the embodiment of the present invention does not require to be divided into smaller display unit. Under a situation of an entire sub-pixel unit, through alternate dark and bright display method to achieve a large viewing angle characteristic, the transmittance of the liquid crystal panel is increased.

The embodiment of the present invention also provides a liquid crystal panel, and the liquid crystal panel is suitable for the driving methods described above. Specifically, please refer to FIG. 7.

Figure 7:
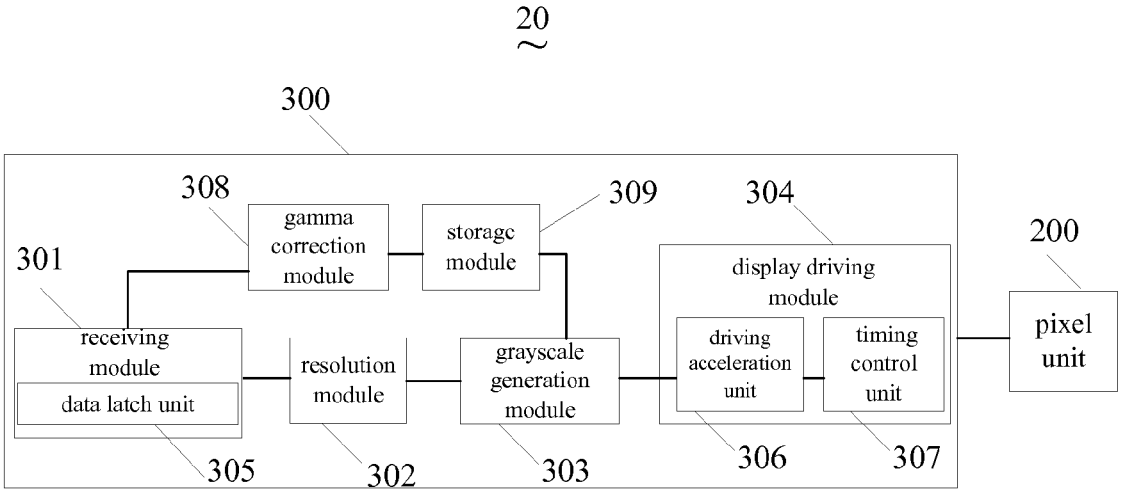
FIG. 7 is a schematic diagram of a liquid crystal panel according to an embodiment of the present invention.

As shown in FIG. 7, the embodiment of the present invention provides a liquid crystal panel 20 including multiple pixel units 200 and a driving circuit 300. Wherein, the driving circuit 300 provides driving signals to the pixel units 300.

In the present embodiment, the structures of the pixel units are shown as FIG. 4 to FIG. 6. The multiple pixel units 200 are arranged as a matrix. Each pixel unit 200 includes multiple sub-pixel units arranged sequentially and corresponding to different colors. The sub-pixel units include four sub-pixel units of R, G, B and W sub-pixel units such as the sub-pixel units 201-204 shown in FIG. 4. Wherein, the R, G, B and W sub-pixel units 201-204 respectively display a red color, a green color, a blue color and a white color.

In another embodiment, the pixel unit could only include three sub-pixel units which respectively display a red color, a green color and a blue color.

The driving circuit 300 includes a receiving module 301, a resolution module 302, a grayscale generation module 303 and a display driving module 304.

Wherein, the receiving module 301 is used for receiving a picture information. The receiving module 301 also includes a data latch unit 305 for buffering and storing the received picture information.

Each picture includes the following information: each picture is formed by multiple pixels (that is, the pixel units), and each pixel is formed by multiple colors displayed by different grayscales. In the present embodiment, each pixel is formed by four colors of a R (red), G (green), B (blue) and W (White) displayed by different grayscales.

In another embodiment, each pixel could be formed only by three colors of a R (red), a G (green), a B (blue) displayed by different grayscales.

The resolution module 302 is used for analyzing and obtaining an original grayscale value of each color of multiple pixel units in the picture information.

Grayscales can represent different brightness levels of a color from the darkest to the brightest. If the brightness levels are more, a picture effect is finer. Using 8 bit panel as an example, the panel can show the 8th power of 2, which equals to 256 brightness levels. When a color is darker, a corresponding grayscale value is smaller, and vice versa.

Specifically, the resolution module 302 analyzes a corresponding grayscale value according to a brightness of the each color in order to obtain an original grayscale.

The grayscale generation module 303 is used for generating a first display grayscale and a second display grayscale according to the original grayscale of the each color. Wherein, a display brightness corresponding to the first display grayscale is greater than a display brightness corresponding to the second display grayscale. Wherein, a display brightness corresponding to the original grayscale is a half of a sum of the display brightness corresponding to the first display grayscale and the display brightness corresponding to the second display grayscale. The specific operation principle is described above.

The display driving module 304 utilizes the first display grayscale and the second display grayscale of the each color of the multiple pixel units to drive sub-pixel unit which is corresponding to the each color in two adjacent pixel units corresponding to each pixel unit to respectively perform a dark display and a bright display. Wherein, the driving method of the display driving module 304 specifically includes following three methods:

The first driving method: using one sub-pixel unit as one unit to drive sub-pixel units to alternately perform a dark display and a bright display, wherein, when one of the sub-pixel units is driven by the first display grayscale, adjacent and peripheral sub-pixel units are driven by the second display grayscale, and when one of the sub-pixel units is driven by the second display grayscale, adjacent and peripheral sub-pixel units are driven by the first display grayscale.

The second driving method: using a combination of the sub-pixel units as one unit to drive the sub-pixel units to alternately perform a dark display and a bright display, wherein, each combination of the sub-pixel units includes at least two adjacent sub-pixel units, when a combination of the sub-pixel units is driven by a first display grayscale, adjacent and peripheral combinations of the sub-pixel units are driven by a second display grayscale, and when a combination of the sub-pixel units is driven by a second display grayscale, adjacent and peripheral combinations of the sub-pixel units are driven by a first display grayscale.

The third driving method: using one row or one column as one unit to drive the sub-pixel units of one row or one column to alternately perform a dark display and a bright display, wherein, when sub-pixel units of one row or one column are driven by a first display grayscale, adjacent and peripheral sub-pixel units of one row or one column are driven by a second display grayscale, and when sub-pixel units of one row or one column are driven by a second display grayscale, adjacent and peripheral sub-pixel units of one row or column are driven by a first display grayscale.

Wherein, the specific operation principles of the first driving method, the second driving method and the third driving method, and the replacement solutions are described above.

In the present embodiment, the display driving module 304 also includes a driving acceleration unit 306, a timing control unit 307. Wherein, the driving acceleration unit 306 is used for increasing a tilting voltage of liquid crystal molecules so as to shorten a response time of each grayscale. The timing control unit 307 is used for controlling an output time of a signal.

In the present embodiment, the liquid crystal panel 20 also includes a gamma correction module 308 and a storage module 309. Wherein, the gamma correction module 308 is used for performing a gamma correction for the picture information received by the receiving module 301 in order to decrease the distortion rate of the picture information. The storage module 309 is used for storing a relationship between a grayscale of each color and a display brightness. Wherein, the grayscale of each color include an original grayscale of each color, and a first display grayscale and a second display grayscale corresponding to the original grayscale.

As described above, the sub-pixel unit of the embodiment of the present invention does not require to be divided into smaller display unit. Under a situation of an entire sub-pixel unit, through alternate dark and bright display method to achieve a large viewing angle characteristic, the transmittance of the liquid crystal panel is increased.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A driving method for a liquid crystal panel, wherein, the liquid crystal panel includes multiple pixel units arranged as a matrix, each pixel unit includes multiple sub-pixel units arranged sequentially and corresponding to different colors, the driving method comprising following steps:

receiving a picture information;

analyzing and obtaining an original grayscale of each color of the multiple pixel units;

generating a first display grayscale and a second display grayscale according to the original grayscale of the each color, wherein, a display brightness corresponding to the first display grayscale is greater than a display brightness corresponding to the second display grayscale, and a display brightness corresponding to the original grayscale is a half of a sum of the display brightness corresponding to the first display grayscale and the display brightness corresponding to the second display grayscale; and using the first display grayscale and the second display grayscale of the each color of the multiple pixel units to drive sub-pixel unit which is corresponding to the each color in two adjacent pixel units corresponding to each pixel unit to respectively perform a dark display and a bright display;

wherein, the sub-pixel units includes a R, a G, a B and a W sub-pixel units, and the R, G, B and W sub-pixel units respectively display a red color, a green color, a blue color and a white color.

2. The driving method according to claim 1, wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes:

using one sub-pixel unit as one unit to drive sub-pixel units to alternately perform the dark display and the bright display, wherein, when one of the sub-pixel units is driven by the first display grayscale, adjacent and peripheral sub-pixel units are driven by the second display grayscale, and when one of the sub-pixel units is driven by the second display grayscale, adjacent and peripheral sub-pixel units are driven by the first display grayscale.

3. The driving method according to claim 1, wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes:

using a combination of the sub-pixel units as one unit to drive the sub-pixel units to alternately perform the dark display and the bright display, wherein, each combination of the sub-pixel units includes at least two adjacent sub-pixel units, when a combination of the sub-pixel units is driven by the first display grayscale, adjacent and peripheral combinations of the sub-pixel units are driven by the second display grayscale, and when a combination of the sub-pixel units is driven by the second display grayscale, adjacent and peripheral combinations of the sub-pixel units are driven by the first display grayscale.

4. The driving method according to claim 1, wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes:

using one row or one column as one unit to drive the sub-pixel units of one row or one column to alternately perform the dark display and the bright display, wherein, when sub-pixel units of one row or one column are driven by the first display grayscale, adjacent and peripheral sub-pixel units of one row or one column are driven by the second display grayscale, and when sub-pixel units of one row or one column are driven by the second display grayscale, adjacent and peripheral sub-pixel units of one row or column are driven by the first display grayscale.

5. A driving method for a liquid crystal panel, wherein, the liquid crystal panel includes multiple pixel units arranged as a matrix, each pixel unit includes multiple sub-pixel units arranged sequentially and corresponding to different colors, the driving method comprising following steps:

receiving a picture information;

analyzing and obtaining an original grayscale of each color of the multiple pixel units;

generating a first display grayscale and a second display grayscale according to the original grayscale of the each color, wherein, a display brightness corresponding to the first display grayscale is greater than a display brightness corresponding to the second display grayscale, and also greater than a display brightness corresponding to the original grayscale;

wherein, the display brightness corresponding to the original grayscale is greater than the display brightness corresponding to the second display grayscale; and using the first display grayscale and the second display grayscale of the each color of the multiple pixel units to drive sub-pixel units which is corresponding to the each color in two adjacent pixel units corresponding to each pixel unit to respectively perform a dark display and a bright display.

6. The driving method according to claim 5, wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes:

using one sub-pixel unit as one unit to drive sub-pixel units to alternately perform the dark display and the bright display, wherein, when one of the sub-pixel units is driven by the first display grayscale, adjacent and peripheral sub-pixel units are driven by the second display grayscale, and when one of the sub-pixel units is driven by the second display grayscale, adjacent and peripheral sub-pixel units are driven by the first display grayscale.

7. The driving method according to claim 5, wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes:

using a combination of the sub-pixel units as one unit to drive the sub-pixel units to alternately perform the dark display and the bright display, wherein, each combination of the sub-pixel units includes at least two adjacent sub-pixel units, when a combination of the sub-pixel units is driven by the first display grayscale, adjacent and peripheral combinations of the sub-pixel units are driven by the second display grayscale, and when a combination of the sub-pixel units is driven by the second display grayscale, adjacent and peripheral combinations of the sub-pixel units are driven by the first display grayscale.

8. The driving method according to claim 5, wherein, step of using the first display grayscale and the second display grayscale of each color of the multiple pixel units to drive sub-pixel units which is corresponding to the each color in two adjacent pixel units corresponding to each pixel unit to respectively perform a dark display and a bright display includes:

using one row or one column as one unit to drive the sub-pixel units of one row or one column to alternately perform the dark display and the bright display, wherein, when sub-pixel units of one row or one column are driven by the first display grayscale, adjacent and peripheral sub-pixel units of one row or one column are driven by the second display grayscale, and when sub-pixel units of one row or one column are driven by the second display grayscale, adjacent and peripheral sub-pixel units of one row or column are driven by the first display grayscale.

9. The driving method according to claim 5, wherein, the sub-pixel units includes a red (R), a green (G), a blue (B) and a white (W) sub-pixel units, and the red (R), the green (G), the blue (B) and the white (W) sub-pixel units respectively display a red color, a green color, a blue color and a white color.

* * * * *